US005630744A

United States Patent [19]

Bandy

[11] Patent Number: 5,630,744

[45] Date of Patent: May 20, 1997

[54] TOY GUN WITH BLOWING-OPERATED NOISEMAKER

[76] Inventor: Leon D. Bandy, 2116 W. Utopia Rd., Phoenix, Ariz. 85027

[21] Appl. No.: 522,510

[22] Filed: Sep. 1, 1995

[51] Int. Cl.[6] ..... A63H 05/00

[52] U.S. Cl. ..... 446/202; 446/81; 446/204; 446/405

[58] Field of Search ..... 446/81, 397, 404, 446/405, 202–209; D21/64; 116/137 R, 147

[56] References Cited

U.S. PATENT DOCUMENTS

| | | | |
|---|---|---|---|
| D. 29,907 | 12/1898 | King | 446/205 |
| D. 165,946 | 2/1952 | Thompson | D21/64 |
| D. 173,425 | 11/1954 | Gurtov | D21/64 |
| 704,233 | 7/1902 | Brown | D21/64 |
| 747,078 | 12/1903 | Leipold | 446/202 |
| 951,801 | 3/1910 | Chevers | 446/81 |
| 1,133,741 | 3/1915 | Osborn | 446/203 |
| 1,383,878 | 7/1921 | Taylor | D21/64 |
| 3,085,150 | 4/1963 | Bautsch | 446/81 |
| 3,139,087 | 6/1964 | Liberatore | 446/204 |
| 3,824,949 | 7/1974 | Aquila | 116/137 R |
| 3,924,348 | 12/1975 | Taylor | 446/204 |

FOREIGN PATENT DOCUMENTS

| | | | |
|---|---|---|---|
| 476124 | 8/1951 | Canada | 446/203 |
| 9311842 | 6/1993 | WIPO | 446/202 |

*Primary Examiner*—Robert A. Hafer
*Assistant Examiner*—Jeffrey D. Carlson
*Attorney, Agent, or Firm*—Martin L. Stoneman

[57] ABSTRACT

This invention provides blowing-operated noisemakers to toy guns of the type which are sized to be graspable by one or two hands and which are pointable by the user. Toy gun devices are provided in which user-blown air may be routed from a mouthpiece to a gun-mounted noisemaker by way of a hollow pipe or hose. Variable noises may be made by the user by controlling the blown air, as by using a rotary whistle. The sounds emanating from the toy gun are emitted in the direction in which the toy gun is pointed.

1 Claim, 1 Drawing Sheet

FIG. 1
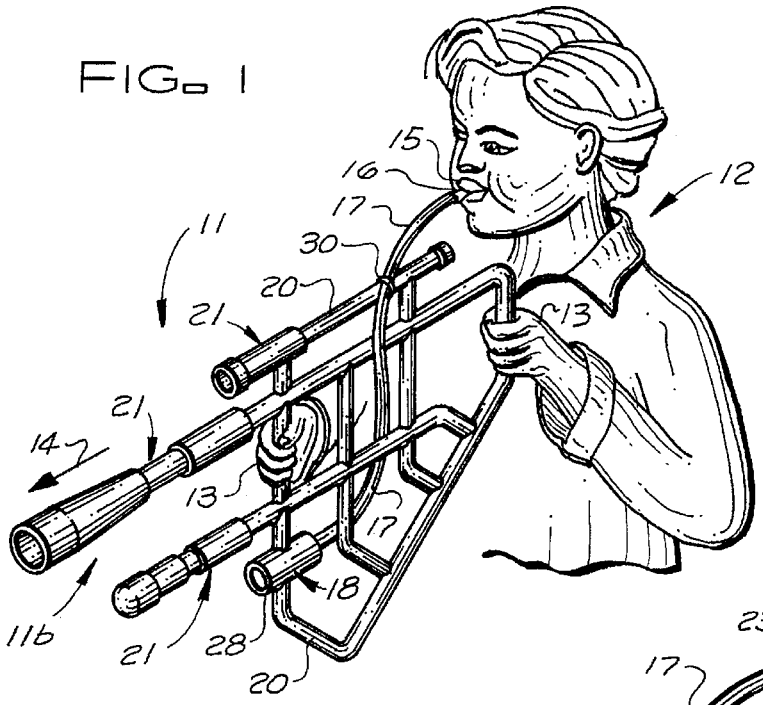
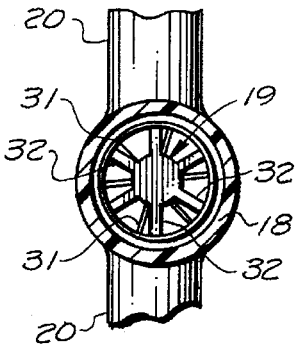
FIG. 4
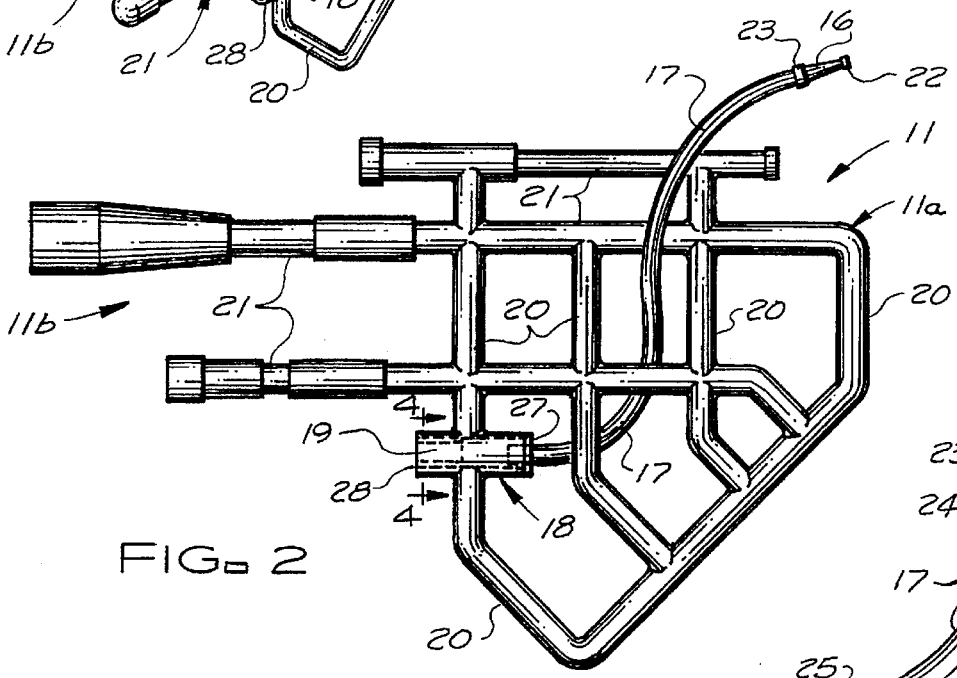
FIG. 2
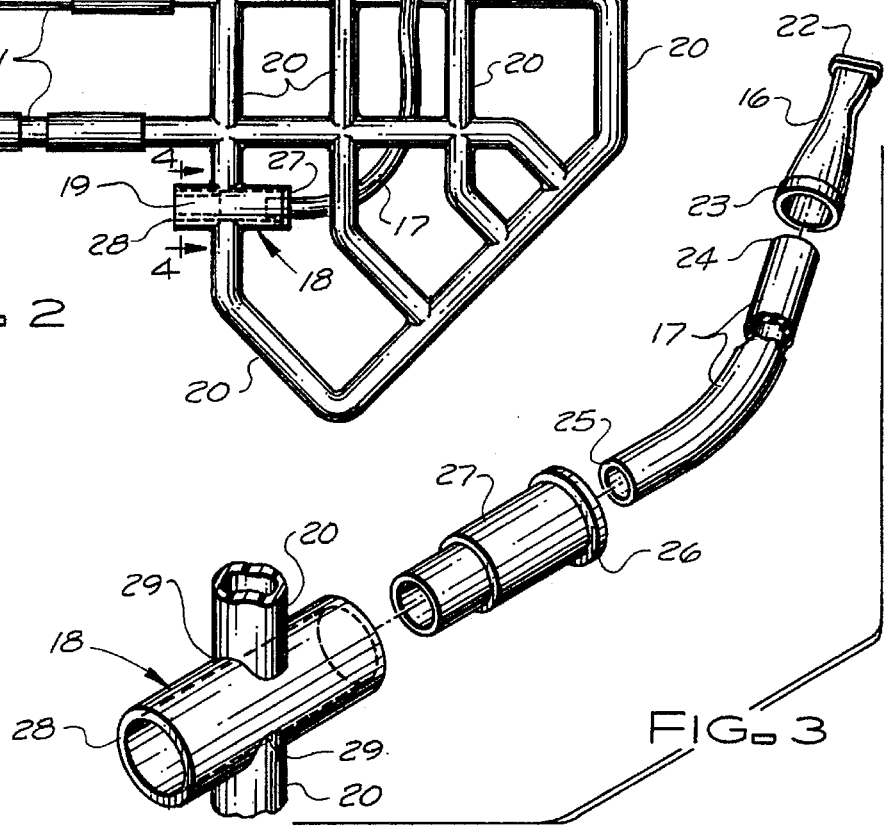
FIG. 3

TOY GUN WITH BLOWING-OPERATED NOISEMAKER

BACKGROUND OF THE INVENTION

1. Field of the Invention

This invention relates to providing blowing-operated noisemakers to toy guns of the type which are sized to be graspable by one or two hands and which are pointable by the user. More particularly, this invention concerns toy gun devices which provide a system whereby user-blown air may be routed to the noisemaker.

2. Description of the Prior Art

In the prior art, air-blowing-operated noisemakers of various kinds are well known. And they have been used for entertainment purposes in connection with various toys, for example: coiled pneumatic tubes which are blown to be uncoiled and make sounds (see U.S. Pat. No. 530,909 to Stone); sounding toys wherein a tube is blown into by either of two users and a sound made by the oral cavity of the other (see U.S. Pat. No. 1,526,030 to Ward); toy whistles where the sound is variable by moving a plunger in a cylinder (see U.S. Pat. No. 2,006,274 to Kushner); toy whistles in connection with water-spray discharges (see U.S. Pat. No. 2,851,270 to Ball); and various musical toys (see, for example, U.S. Pat. No. 3,924,348 to Taylor et al).

Toy guns, however, even when including noisemakers, have typically utilized different forms of noisemakers, primarily those which imitate the crack of gunfire.

In this day and age of futuristic fantasies involving pointable weapons, in movies, books, and television, there exists an entertainment need for toy guns for youthful consumers. These toy guns should have unusual sounds for guns, should have variable sounds for guns, and should have sounds which otherwise enhance the ideas of different worlds with different weapons.

OBJECTS OF THE INVENTION

A primary object of the present invention is to fulfill the above-mentioned entertainment need by the provision of such toy guns which provide unusual sounds and variable sounds. A further primary object of the present invention is to provide such toy guns in which such variable sounds are under the instant control of the user. In addition, it is a primary object of this invention to provide such toy guns which point such unusual sounds in the direction in which the user is pointing the toy gun. Other objects of this invention will become apparent with reference to the following invention descriptions.

SUMMARY OF THE INVENTION

According to a preferred embodiment of the present invention, there is provided a device comprising, in combination, a toy gun having a frame which is graspable and pointable by a user, a blowing-operated noisemaker attached to such frame, a mouthpiece portion positioned to be blown into by such user, and a hollow cylindrical member attached at a first end of such hollow cylindrical member to such mouthpiece portion and attached at a second end of such hollow cylindrical member to such blowing-operated noisemaker, whereby, when such user blows into such mouthpiece portion, such blowing-operated noisemaker makes sounds. Also provided in this preferred embodiment is such a device wherein such toy gun is constructed and arranged so that, when such mouthpiece portion is blown into by such user, such sounds are emitted from such blowing-operated noisemaker in the direction in which such toy gun is pointed.

Additionally, this invention provides such a device wherein such hollow cylindrical member comprises a flexible plastic hose. Further provided in accordance with this invention is such a device wherein such blowing-operated noisemaker comprises a noisemaker of the type where such sounds are easily varied with the strength of such blowing by such user. Yet further, this invention provides such a device wherein such blowing-operated noisemaker comprises a rotary whistle. Even further, there is provided such a device wherein a straight hollow cylinder attached to such frame contains such blowing-operated noisemaker; and, further, wherein such straight hollow cylinder is positioned substantially in the direction in which such toy gun is pointed (whereby, when such mouthpiece portion is blown into by such user, such sounds are emitted from such blowing-operated noisemaker in the direction in which such toy gun is pointed).

Yet additionally, according to a preferred embodiment of the present invention, there is provided a device comprising, in combination, a toy gun having a frame which is graspable and pointable by a user and having a user end and a pointable end, a hollow cylindrical member having a first end and a second end, a blowing-operated noisemaker at such second end of such hollow cylindrical member, and a mouthpiece portion at such first end of such hollow cylindrical member, whereby, when such user blows into such mouthpiece portion, such blowing-operated noisemaker makes sounds. Also provided is such device wherein such mouthpiece portion is adjacent such user end of such toy gun. Even further provided by this invention is such device wherein such blowing-operated noisemaker comprises a noisemaker of the type where such sounds are easily varied with the strength of such blowing by such user. Additionally, this invention provides, according to this preferred embodiment, such device wherein such toy gun is constructed and arranged so that, when such mouthpiece portion is blown into by such user, such sounds are emitted from such blowing-operated noisemaker in the direction in which such toy gun is pointed.

Yet further, according to a preferred embodiment of the present invention, there is provided a device comprising, in combination, a toy gun having a frame which is graspable and pointable by a user and having a user end and a pointable end, an air-blowing-operated noisemaker attached to such toy gun, and a mouthpiece portion positioned adjacent such user end of such toy gun, such device being constructed and arranged so that, when such user blows into such mouthpiece portion, such air-blowing-operated noisemaker makes sounds. Additionally provided is such device wherein such device is constructed and arranged so that, when such mouthpiece portion is blown into by such user, such sounds are emitted from such air-blowing-operated noisemaker in the direction in which such toy gun is pointed.

BRIEF DESCRIPTION OF THE DRAWINGS

FIG. 1 illustrates pictorially the use of a preferred embodiment of a toy gun according to the present invention.

FIG. 2 is a plan view of the preferred embodiment of the present invention of FIG. 1.

FIG. 3 is an exploded view, in perspective, of the parts of the present invention involved in the blowing-operated noisemaking.

FIG. 4 is an expanded view of the noisemaker portion of the present invention, partially in section, through the section 4-4 of FIG. 2.

DETAILED DESCRIPTION OF A PREFERRED EMBODIMENT AND THE BEST MODE OF PRACTICE

FIG. 1 illustrates pictorially the use of a preferred embodiment of a toy gun according to the present invention. The toy gun 11 (having a user end 11*a* and a pointable end 11*b*) is shown being grasped by a child 12, the toy gun user, who is using both hands 13 to grasp toy gun 11. The child 12 is shown pointing the toy gun 11 in the direction of arrow 14. The lips 15 of the child 12 are shown around mouthpiece portion or mouthpiece 16 (located near the user end 11*a* of toy gun 11), into which mouthpiece 16 the child may blow air. Any such blown air will be routed through hollow cylindrical member 17 to straight hollow cylinder 18, which contains therein blowing-operated noisemaker 19 (not visible in FIG. 1).

Straight hollow cylinder 18 is attached to the frame 20 of toy gun 11 and is pointed in the same direction 14 as the various longitudinal toy gun parts 21 which tell child 12 in which direction the toy gun 11 is pointed. Blowing-operated noisemaker 19 is mounted within straight hollow cylinder 18 and in line with straight hollow cylinder 18 so that the sounds emitted from blowing-operated noisemaker 19 are emitted in the direction 14 in which toy gun 11 is pointed.

FIG. 2 is a plan view of the preferred embodiment of the present invention of FIG. 1; and FIG. 3 is an exploded view, in perspective, of the parts of the present invention involved in the blowing-operated noisemaking. FIGS. 2 and 3 show more completely the entire mouthpiece 16 into which, according to the present invention, air may be blown. The front end 22 of mouthpiece portion or mouthpiece 16 is blown into by the child 12 in order to operate the present invention. The rear end 23 of mouthpiece 16 fits snugly over the front end 24 of hollow cylindrical member 17, thus providing a sealed path for blown air into hollow cylindrical member 17. The rear end 25 of hollow cylindrical member 17 fits snugly into the front end 26 of fitting 27, thus providing a sealed path for blown air into fitting 27.

As shown, fitting 27 fits snugly into straight hollow cylinder 18, thus providing a sealed path for blown air into straight hollow cylinder 18. As shown, blowing-operated noisemaker 19 is mounted within and adjacent to the rear end 28 of straight hollow cylinder 18 in such manner that air blown into blowing-operated noisemaker 19 from fitting 27 operates blowing-operated noisemaker 19 to emit noise out the rear end 28 of straight hollow cylinder 18 in the direction 1 in which the toy gun 11 is pointed. As shown, straight hollow cylinder 18 is securely mounted to frame 20 at mounting areas 29, so as to be in line with longitudinal toy gun parts 21 in direction 14.

All of the parts of toy gun 11 are preferably made of rigid plastic materials in well-known ways, excepting for hollow cylindrical member 17, which in a first preferred embodiment (see FIG. 1) is preferably made of a flexible plastic hose material in well-known ways and is connected to toy gun 11, as shown in FIG. 1, by elastic band 30 close enough to mouthpiece 16 to provide a relatively stable location for mouthpiece 16 for ease of use. Alternatively, in a second preferred embodiment, hollow cylindrical member 17 is preferably made of a rigid plastic pipe material in well-known ways and, if made so rigid, in addition to its connection to fitting 27, hollow cylindrical member 17 may for added stability be wedged within (see FIG. 2) or otherwise attached to frame 20 of toy gun FIG. 4 is an expanded view of the noisemaker portion of the present invention, partially in section, through the section 4—4 of FIG. 2. The blowing-operated noisemaker 9, according to the preferred illustrated embodiment of applicant's invention, is preferably made of rotary whistle 31 in well-known ways. As shown in FIG . 4, looking through the section 4—4 of FIG. 2 at the sound-emitting end of rotary whistle 31, rotary whistle 31 is mounted within straight hollow cylinder 18 near the rear end 28 of straight hollow cylinder 18. Rotary whistle 31, as shown, fills the internal diameter of straight hollow cylinder 18 so that, in using the toy gun 11, all of the air blown by the child 12 into the mouthpiece 16 will pass through the rotary blades 32 of the rotary whistle 31, thus turning rotary blades 32 and making a whistling sound in well-known ways. The pitch and loudness of rotary whistle 31 may be varied by the child 12 using the toy gun 11 by controlling the stream of air blown into mouthpiece 16, thus providing greater entertainment value in well-known ways.

Thus, in using the preferred embodiment of the toy gun 11 of the present invention, a user like child 12 may engage in fantasy play by pointing the toy gun 11 and, when the child 2 wishes, by grasping the mouthpiece 16 with the child's lips 15 and, by blowing a controlled stream of air, make widely varying whistling sounds to accompany the fantasy use of toy gun 11. In accordance with the present invention, such use of toy gun 11 provides much quality entertainment to the user of toy gun 1 in futuristic fantasy play.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A device comprising, in combination:

a. a toy gun having a longitudinal pointable direction and having a rigid frame, said frame comprising at least three discrete, spaced, substantial frame portions, each said substantial frame portion lying along a different straight line from each other substantial frame portion and each said straight line being parallel to said longitudinal pointable direction, whereby said toy gun is graspable and pointable by a user;

b. at least one said substantial frame portion comprising a straight hollow cylinder;

c. a blowing-operated noisemaker attached within said straight hollow cylinder;

d. a mouthpiece portion positioned to be blown into by a user; and e. a hollow cylindrical member attached at a first end of said hollow cylindrical member to said mouthpiece portion and attached at a second end of said hollow cylindrical member to said blowing-operated noisemaker;

f. whereby, when a user blows into said mouthpiece portion, said blowing-operated noisemaker makes sounds;

g. wherein said toy is constructed and arranged so that, when said mouthpiece portion is blown into by a user, said sounds are emitted from said blowing-operated noisemaker in said longitudinal pointable direction.

* * * * *